United States Patent [19]

Glass et al.

[11] 3,990,742

[45] Nov. 9, 1976

[54] ADJUSTABLE SPINAL CONTOUR SEATING

[76] Inventors: Katalina T. Glass, 8787 Shoreham Drive, Los Angeles, Calif. 90069; Peyton L. Massey, 12221 Wilshire Blvd., Los Angeles, Calif. 90025

[22] Filed: July 3, 1975

[21] Appl. No.: 592,872

[52] U.S. Cl. ..... 297/283; 297/284

[51] Int. Cl.[2] ..... A47C 27/00; A47C 3/00

[58] Field of Search ..... 297/283, 284; 108/107, 108/110

[56] References Cited

UNITED STATES PATENTS

| | | | |
|---|---|---|---|
| 506,829 | 10/1893 | Ohmer | 108/110 |
| 3,632,170 | 1/1972 | Witt | 297/454 X |
| 3,663,055 | 5/1972 | Gale | 297/284 X |

*Primary Examiner*—James C. Mitchell

[57] ABSTRACT

A chair or the like having a frame comprised of spaced parallel rails between which a plurality of juxtapositioned rungs are adjustably displaced according to a prescription which determines a supporting contour for the seat or back of said chair. Several rungs are provided, and each with a distinct offset mounting by means of which a substantial selection of displacements are obtained for fixed positioning of the rungs, there being flexible cushioning overlying the rungs for determined support of a person seated thereon.

20 Claims, 7 Drawing Figures

ADJUSTABLE SPINAL CONTOUR SEATING

BACKGROUND

Seating is necessarily related to posture in the construction of chairs and lounges for the support of the human body. Involved is the head, torso and limbs of the body; the spinal column being subject to curvatures imposed by the contours of the seat cushion and back cushion. Generally, it is conventional to provide seating in the form of a chair having a horizontally disposed seat cushion with a vertically disposed back cushion extended upwardly therefrom. The cushion effect is provided for comfort, and the depth of cushioning and disposition to horizontal and/or vertical is normally established according to generalized requirements, but not necessarily suited to each individual. Further, the supporting surfaces of the cushions have been contoured, and all to the end of providing comfort for the body. However, the ordinary seating structure is inflexible with respect to selective adjustment to an individuals posture requirements, and therefore a most common human ailment is back and/or spinal column problems arising out of poor seating posture. Since the posture of sitting is required of many persons, over long periods of time, it is an object of this invention to provide seating that is selectively adjustable to optimum requirements. With the present invention, an individual person can adjust a chair to suit his desires, her desires, according to exacting curvatures prescribed according to spinal column posture requirements.

The contouring of chairs seats and backs is ordinarily a function of cushion depth and padding as it is installed upon a frame, and the frame is not determinative of the supporting contours. Firmness of the cushioning is also a controlling factor; and all of which are ordinarily fixed into the chair structure with articulated sections that adjust for general angular relationships to the various body parts of the person seated thereon. However it is these various sectional areas of body support which require contouring as prescribed according to spinal column requirements of a particular individual, and to this end it is an object of this invention to provide coextensive cushion contouring for both the seat and the back of a chair or the like. With the present invention, juxtapositioned rungs are selectively displaced from supporting rails at specified distances according to the prescription of the contour required.

The adjustability of chair rungs is a novel concept for the purpose and/or function of cushion adjustment, and it is an object of this invention to provide a simple and practical reception of rungs in fixed position on spaced rails, with displaced adjustability determined by the mounting configuration between the rungs and rails. In practice, the rungs are sustantially rigid members mounted to the rails by non-rotatable trunnions, there being a plurality of rung configurations and each adapted to multi-positioning for their selective displacement and consequent contouring as prescribed.

The aforementioned concept is practical in every respect and is adaptable to varied chair or seating designs. Objectively, it is of primary purpose to provide a selectively contoured backing for a seat or back cushion, and all of which is to be combined in a chair frame or the like for the partial or total support of the human body incluing the head, torso and limbs, as the case may be.

SUMMARY OF INVENTION

The primary purpose of the adjustable contouring provided by this invention is to condition the seat and/or back of a chair or the like according to the prescription required for relief of pressure on limbs and/or the individual spinal column posture. This adjustably contoured seating is applicable to both the seat and the back, as the underlying support for cushioning that is flexible and adaptable to the prescribed contour. The chair frame can vary widely in construction characterized by spaced rails A between which the contouring means is extended, a typical frame being comprised of a pedestal support B, a seat section C and a back section D. The pedestal support B is shown as being of the swivel type (detail not shown) and the sections C and D are rectangular perimeter frames that are covered or upholstered. In practice, a pad overlies the inner supporting side of both sections C and D, there being a seat pad 10 and a back pad 11 made of covered foamed plastic or the like. The pads can be loose or fastened to the perimeter frame and/or rails A. In accordance with this invention, there are rungs which are adjacently juxtapositioned to extend transversely between the rails A, there being complementary racks 12 carried by spaced rails to receive and fixedly support the rungs by means of trunnions 13. The racks 12 are disposed in a body supporting plane from which the rungs are adjustably displaced through the selective engagement of the trunnions 13 which are offset with respect to the rung cross section. A feature of the invention is the polygonal configuration of the trunnions 13 which are removeable from recesses 14 in the racks 12 and within which they are non-rotatable.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
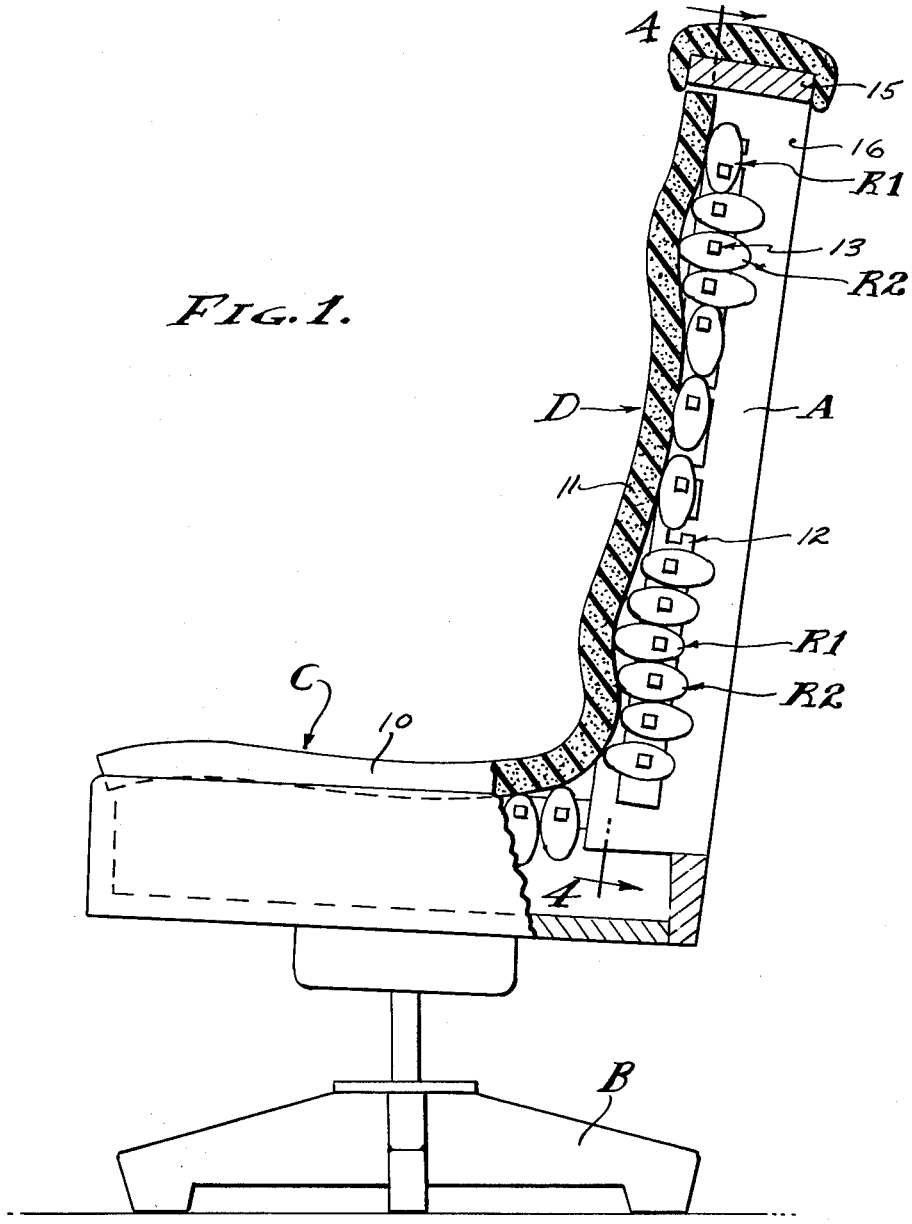
FIG. 1 is an elevational view of a chair partially in section and showing the adjustably contoured rungs of the present invention.
Figure 2:
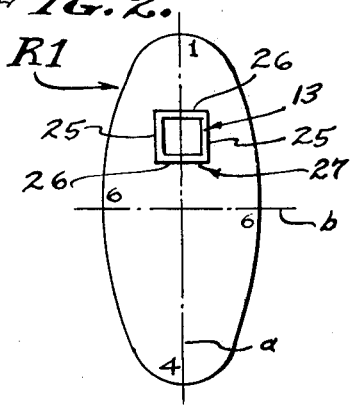
FIGS. 2 and 3 are enlarged detailed end views of the two rungs employed.
Figure 3:
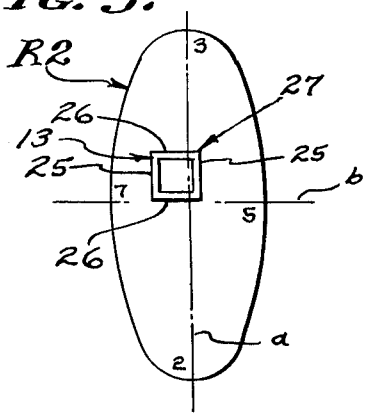
Figure 4:
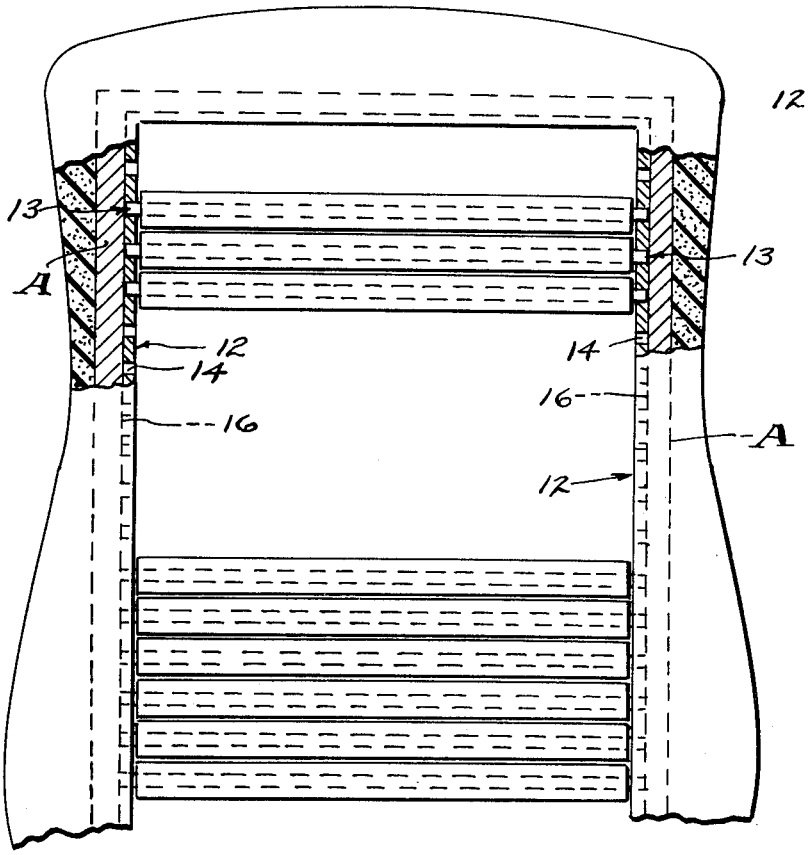
FIG. 4 is a view, partially in section, and taken as indicated by line 4—4 on FIG. 1.
Figure 5:
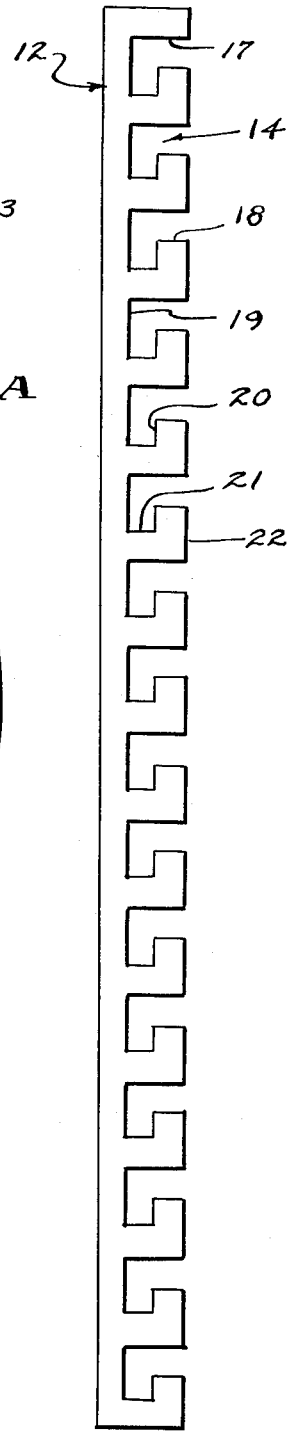
FIG. 5 is an enlarged detailed view of one of the complementary racks as shown employed in FIG. 1.
Figure 6:
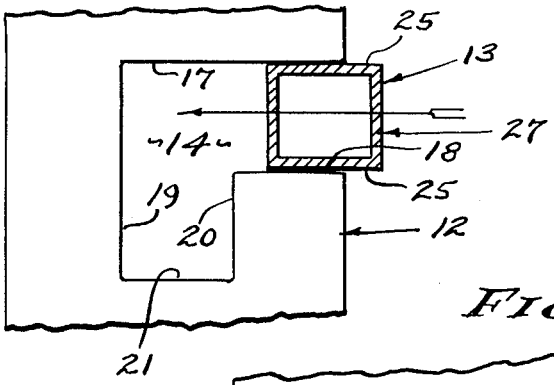
FIGS. 6 and 7 are enlarged detailed fragmentary views showing the manner of insertion for positioning the rung trunnions in the recesses of the racks.
Figure 7:
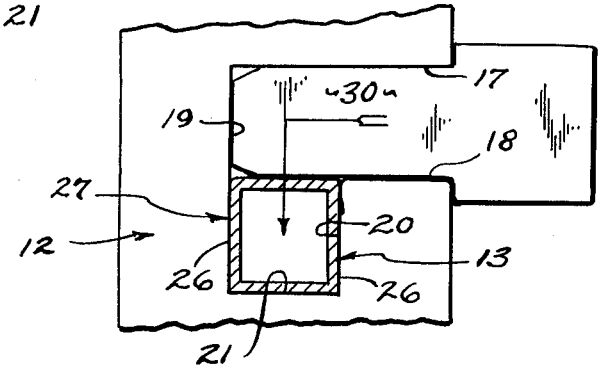

Referring now to the drawings, a typical frame is shown embodying the adjustable contour backing means which includes the aforementioned racks 12 and selectively displaced rungs. Although the contoured adjustability is applicable to either or both the seat section C and the back section D, only the application to a back section is shown and described herein. Characteristically, the chair frame is a rigid structure having parallel side rails A extended upwadly from the rear of the seat section C and joined in spaced relation by header 15. In practice, wooden frame members are employed in fabricating the section D and rails thereof, presenting opposed parallel inner faces 16.

In accordance with this invention, a pair of complementary racks 12 are secured to and carried by the rails A, at the inner faces 16 thereof and disposed in a common supporting plane beneath or rearward of the overlying cushion or back pad 11. As shown, the racks are identical elongated plate-like members notched with a series of equally spaced recesses 14 that open rearwardly (upwardly at the seat section) from the back section. In practice, the recesses 14 are spaced 1½ inches apart and the recesses of opposite racks 12 being of matched height. A feature of the racks is the locking configuration of the recesses 14, all of which are of identical formation, that removeably receive the polygonal trunnions 13 which are fixedly positioned and held non-rotatable thereby. The trunnions 13 are square and are slideably insertable into the recesses 14 by means of two right angularly related motions to be seated initially by the action of gravity and thereafter locked into position by the stacked and/or juxtapositioned rung cross sections. Accordingly, each recess 14 has a normal entry passage with opposite side walls 17 and 18 slideably engageable with one pair of opposite trunnion faces, and has a right angular receiver with opposite side walls 19 and 20 slideably engageable with the other pair of opposite trunnion faces and with a seat 21 to positionably stop the trunnion in a fixed position. In practice, the walls 17 and 18 and seat 21 are at right angles to the rear edge 22 of the rack 12, and the walls 19 and 20 are parallel therewith, the wall 20 forming a step preferably equal in height to the square dimension of the trunnion 13.

The rungs are provided in several configurations, all of the same cross section but provided with distinctly adjustable mounting means. With the several (two) rungs R1 and R2 as will now be described, seven lateral displacements of the rack 12 are obtained. It is the placement of the trunnions 13 which obtain the multiplicity of adjusted height displacements, effected by rotational positioning of the rungs. Accordingly, there are two rung configuration, the rung R1 and the rung R2. It will be observed that the trunnions 13 are of identical square configuration having two pairs of opposite faces 25—25 and 26—26, and that the trunnions of the two distinct rungs are displaced at laterally distinct positions relative to the transversely extending axis of the rungs, respectively. Further, it is significant that the rung is of flattened cross section, preferably an oval of foamed plastic of rigid but slightly depressible properties molded over a bar or tube member 27 projecting from the opposite ends 28 to form said trunnions 13. It will be seen that the ends 28 fit between the opposite racks or faces 16, depressibly if desired; and that the cross sectional 1½ × 3½ dimensioning thereof provides for juxtapositioned and/or tight stacking of the rungs as may be desired.

The rung R1 is provided for maximum displacement and has its trunnion member 27 located on the major axis a of the eliptical rung cross section and displaced a maximum distance of ¾ inch from the minor axis *b*. Therefore, the rung R1 is primarily adapted to 180° reversal in positioning when reversely inserted into the opposite rack recesses with trunnion faces 25—25 engaged with the entry walls 17 and 18 thereof. However, a third neutral position is obtained by insertion into the opposite rack recesses with the trunnion faces 26—26 engaged with the entry walls 17 and 18 thereof. A first normal motion is impressed upon the trunnion 13 to move it rectilinearly through the entry passage of the recess 14, followed by a second right angular motion impressed thereon to move it rectilinearly into the receiver of the recess 14.

The rung R2 is provided for moderate and minimum displacement and has its trunnion member 27 located off both the major and minor axes *a* and *b* of the eliptical rung cross section, being displaced a moderate distance of ¼ inch from the minor axis *b* and a minimum distance of ⅛ inch from the major axis *a*. Therefore, the rung R2 is adapted to 180° reversal in positioning with respect to both of the two axes when reversely inserted into opposite rack recesses with either the trunnion faces 25—25 or 26—26 selectively engaged with the entry walls 17 and 18 thereof. Thus, four distinct positions are obtained with the rung R2, in addition to the three distinct positions obtained with the rung R1. Like the rung R1, the rung R2 is inserted into the opposite recesses through first and second right angularly related rectilinear motions.

From the foregoing, it will be seen that the two distinct rungs R1 and R2 afford as many as seven selective displacements for contouring the lateral support of a person sitting or reclining upon the chair sections. The seven rung positions are indicated by number to be placed forwardly, as shown, with the rungs slideably inserted into seated positions where they initially rest by gravity. The rungs are subsequently captured and locked against accidental removal by the fitting relationship therebetween and/or by the juxtapositioning of the rung cross sections when installed as shown in assembled combination. A keeper 30 inserted into the recess entry can be employed to capture a rung in position if and when required. The cushion pads 10 and 11 are preferably firm so as to conform strictly to the contour developed by the rungs, being flexible so as to bend into the prescribed body supporting configuration imposing the required posture upon the person seated or reclining thereon.

Having described only typical preferred forms and applications of our invention, we do not wish to be limited or restricted to the specific details herein set forth, but with to reserve to ourselves any modifications or variations that may appear to those skilled in the art:

We claim:

1. An adjustably contoured seating section comprised of spaced parallel rails, opposite racks carried by the rails and having complementary recesses in equally spaced relation for the transverse disposition of a plurality of support rungs with opposite selectively offset trunnions engaged in said recesses, each recess having a substantially horizontal entry passage and a depending receiver angularly related thereto, and each trunnion being polygonal and operable through the entry passage and with at least one face slideably engageable into the receiver and non-rotatably positioning the rungs.

2. The adjustably contoured seating section as set forth in claim 1, wherein each recess has a seat in the receiver for stopped positioning of the trunnion engaged therein.

3. The adjustably contoured seating section as set forth in claim 1, wherein the receiver of each recess has a straight wall slideably engageable with a face of the polygonal trunnion to non-rotatably position the same.

4. The adjustably contoured seating section as set forth in claim 1, wherein the receiver of each recess has a straight wall slideably engageable with a face of the polygonal trunnion to non-rotatably position the same, and wherein each recess has a seat in the receiver for stopped positioning of the trunnion engaged therein.

5. The adjustably contoured seating section as set forth in claim 1, wherein the entry passage and receiver of each recess has angularly related walls slideably engageable with angularly related faces of the polygonal trunnion, respectively, to non-rotatably position the same.

6. The adjustably contoured seating section as set forth in claim 1, wherein the entry passage of each recess has parallel walls engageable with parallel faces of the polygonal trunnion, respectively, to non-rotatably guide the same.

7. The adjustably contoured seating section as set forth in claim 1, wherein the receiver of each recess has parallel walls slideably engageable with parallel faces of the polygonal trunnion to non-rotatably guide and position the same.

8. The adjustably contoured seating section as set forth in claim 1, wherein the entry passage of each recess has parallel walls engageable with one pair of parallel faces of the polygonal trunnion to non-rotatably guide the same, and wherein the receiver of each recess has parallel walls slideably engageable with a second and distinct pair of parallel faces of the polygonal trunnion to non-rotatably guide and position the same.

9. The adjustably contoured seating section as set forth in claim 1, wherein the entry passage and receiver of each recess are right angularly related and each of said trunnions of square configuration to consecutively slide therethrough respectively.

10. The adjustably contoured seating section as set forth in claim 1, wherein the entry passage and receiver of each recess are right angularly related and each of said trunnions of square configuration to consecutively slide therethrough respectively, and wherein each recess has a seat in the receiver for stopped positioning of the trunnion engaged therein.

11. An adjustably contoured seating section comprised of spaced parallel rails, opposite racks carried by the rails and having complementary recesses in equally spaced relation disposed in a common supporting plane for the reception of a plurality of adjacently positionable supporting rungs of like flattened cross section having major and minor axes, each recess having a substantially horizontal entry passage and a depending receiver angularly related thereto, each rung having opposite end trunnions of polygonal form operable through the entry passage and with at least one face slideably engageable into the receiver and non-rotatably engaged therein to fixedly position the rung, at least one of said rungs having trunnions offset a distance from one of the axes of the rung cross section for reverse positioning with respect to said supporting plane.

12. The adjustably contoured seating section as set forth in claim 11, wherein at least one of said rungs has trunnions offset a maximum distance from one of the axes of the rung cross section for reverse positioning with respect to said supporting plane, and wherein at least one of said rungs has trunnions offset a minimum distance from said one of the axes of the rung cross section for reverse positioning with respect to said supporting plane.

13. The adjustably contoured seating section as set forth in claim 11, wherein at least one of said rungs has trunnions offset a maximum distance from the minor axis of the rung cross section for reverse positioning with respect to said supporting plane, and wherein at least one of said rungs has trunnions offset a minimum distance from said minor axis of the rung cross section for reverse positioning with respect to said supporting plane.

14. The adjustably contoured seating section as set forth in claim 11, wherein at least one of said rungs has trunnions offset a maximum distance from one of the said axes of the rung cross section for reverse positioning with respect to said supporting plane, and wherein at least one of said rungs has trunnions offset a distance from both said major and minor axes of the rung cross section for reverse positioning with respect to said supporting plane.

15. The adjustably contoured seating section as set forth in claim 11, wherein at least one of said rungs has trunnions offset a maximum distance from the minor axis of the rung cross section for reverse positioning with respect to said supporting plane, and wherein at least one of said rungs has trunnions offset a distance from both said major and minor axes of the rung cross section for reverse positioning with respect to said supporting plane.

16. The adjustably contoured seating secton as set forth in claim 11, wherein the trunnions of at least one rung are coincidental with the major axis of said rung cross section.

17. The adjustably contoured seating section as set forth in claim 11, wherein the trunnions of at least one rung are offset from the major axis of said rung cross section.

18. The adjustably contoured seating section as set forth in claim 12, wherein the trunnions of at least one rung are offset a lesser distance from the major axis of said rung cross section than the second mentioned trunnion offset of minimum distance.

19. The adjustably contoured seating section as set forth in claim 11, wherein the trunnions of at least one rung are coincidental with the major axis of said rung cross section, and wherein the trunnions of at least one rung are offset from the major axis of said rung cross section.

20. The adjustably contoured seating section as set forth in claim 12, wherein the trunnions of at least rung are coincidental with the major axis of said rung cross section, and wherein the trunnions of one rung are offset a lesser distance from the major axis of said rung cross section than the second mentioned trunnion offset of minimum distance.

* * * * *